US007475783B2

(12) United States Patent
Geert-Jensen et al.

(10) Patent No.: US 7,475,783 B2
(45) Date of Patent: Jan. 13, 2009

(54) DISPENSER FOR HOLDING A MEANS FOR HOLDING A PLURALITY OF UNITS FOR DISPENSING, AND A METHOD FOR OPERATING THE DISPENSER

(75) Inventors: Anders Geert-Jensen, Risskov (DK); Sven Morten Lasthein, Risskov (DK)

(73) Assignee: Bang & Olufsen Medicom, A/S, Struer (DK)

( * ) Notice: Subject to any disclaimer, the term of this patent is extended or adjusted under 35 U.S.C. 154(b) by 519 days.

(21) Appl. No.: 10/425,724

(22) Filed: Apr. 30, 2003

(65) Prior Publication Data

US 2004/0217120 A1 Nov. 4, 2004

(51) Int. Cl.
*B65D 83/04* (2006.01)

(52) U.S. Cl. ..... 206/531; 206/536; 206/528

(58) Field of Classification Search ..... 206/528, 206/531, 532, 536, 534.1, 535, 538
See application file for complete search history.

(56) References Cited

U.S. PATENT DOCUMENTS

| | | | | | |
|---|---|---|---|---|---|
| 374,509 | A * | 12/1887 | Thum | 211/50 |
| 1,533,880 | A * | 4/1925 | Malwitz | 273/148 A |
| 2,687,211 | A * | 8/1954 | Sparks | 206/539 |
| 3,429,426 | A * | 2/1969 | Weller et al. | 206/531 |
| 3,741,387 | A * | 6/1973 | Whitecar | 206/459.1 |
| 3,804,330 | A * | 4/1974 | Miller et al. | 239/34 |
| 4,231,477 | A * | 11/1980 | De Felice | 206/532 |
| 4,518,080 | A * | 5/1985 | Ohlson | 206/39 |
| 5,484,064 | A * | 1/1996 | Melichar | 211/50 |
| 5,653,342 | A * | 8/1997 | Eaton | 206/579 |
| 6,523,691 | B2 * | 2/2003 | Raj et al. | 206/538 |
| 6,896,137 | B2 * | 5/2005 | McHutchinson | 206/528 |
| 2003/0111379 | A1 * | 6/2003 | Intini | 206/531 |
| 2004/0188314 | A1 * | 9/2004 | Rock et al. | 206/531 |
| 2005/0178692 | A1 * | 8/2005 | Chang | 206/531 |
| 2005/0183981 | A1 * | 8/2005 | Gelardi | 206/531 |

* cited by examiner

*Primary Examiner*—Mickey Yu
*Assistant Examiner*—Steven A. Reynolds
(74) *Attorney, Agent, or Firm*—Harness, Dickey & Pierce, P.L.C.

(57) ABSTRACT

A dispenser and a means to be held by the dispenser. The means holding a plurality of units to be dispensed one or more at the time. Access to the units taking place via an upper surface of the means. This upper surface may be covered by the dispenser in order to prevent access to the surface while held by the dispenser. The means being bendable away from a rest position, and the dispenser biasing the means away from the rest position in order to maintain the means therein. The dispenser may have an edge portion preventing unintended ejection of the means from the dispenser.

15 Claims, 2 Drawing Sheets

DISPENSER FOR HOLDING A MEANS FOR HOLDING A PLURALITY OF UNITS FOR DISPENSING, AND A METHOD FOR OPERATING THE DISPENSER

The present invention relates to a dispenser for holding a means for holding a plurality of units to be dispensed. The dispenser holds the bendable means in a bent position different from a rest position in order to preferably prevent unintended disassembly or ejection thereof. Also, the dispenser prevents, during holding of the means, access to the units.

The units to be dispensed may be medication, such as pills, tablets or ampoules, or chewing gum or sweets, cigarettes, or the like.

In a first aspect, the invention relates to a dispenser for holding a bendable means for holding a plurality of units to be dispensed to a user, the means having:

an upper surface from which access may be obtained to one or more of the plurality of units and a predetermined rest position, the dispenser being adapted to hold the means so that the means is biased against side portions thereof in order to maintain the means in a position different from its rest position.

The means may be a blister card having one or more compartments or blisters for each holding one or more units, preferably for simultaneous dispensing of all units from each compartment. The upper surface of a blister card is normally the foil-covered surface from which access is gained to a blister or compartment by breaking the foil.

Alternatively, the means may have a single, large compartment from which an operator himself dispenses the unit(s) desired or prescribed.

Further alternatively, the means may, at the upper surface, have open compartment(s) or indentation(s) for holding the units, compartment(s)/indentation(s) closed only by the dispenser.

In a preferred embodiment, the dispenser is adapted to hold the means so that it also covers at least a predetermined part of the upper surface in order to prevent access to units.

The dispenser may fully cover all of the first surface or merely a part thereof through which access may be gained to the units—such as a part having openings or at which openings may be provided. Alternatively, one or more openings or parts wherein openings may be provided may merely be covered in a sufficient degree in order to prevent units from being dispensed.

In a preferred embodiment, the dispenser comprises a slot being able to receive the means therein, the side portions being positioned within the slot. The means may be bent prior to entering the slot, as would normally be the case if the bending is in a direction other than that along which the means enters the slot. Alternatively, the bending may be obtained during the entering of the means into the slot, which may be the case when the bending is along the direction at which the means enters the slot. Preferably, the means is elongated, is introduced into the slot along the longitudinal direction, and is bent along the longitudinal direction during insertion thereof into the slot. This bending may be e.g. an even bending of all of the length of the means or a bending of only part of the length of the means.

In this embodiment, preferably the slot is adapted to fully receive the means through an opening, and wherein the side portions comprise a portion extending away there from and into the slot, the extending portion being positioned at a position further toward an opening of the slot than a position of any part of the means (when fully received in the slot).

In this manner, this extending portion may, in addition to the biasing of the means toward the side portions, prevent accidental or unintended ejection of the means from the slot. If the means were to move outward of the slot, it would abut against the extending portion and normally be stopped thereby, due to the means being biased against the side portion from which the extending portion extends.

In general, this bent/curved state has a number of advantages in that the means is then biased against inner surfaces of the dispenser. A curved element (which in its rest position is straight) will obtain a much more stiff state across the direction of the bend. This may be used for a number of purposes, such as to maintain the blister card in the dispenser and to insure abutment against e.g. the extending portions to prevent ejection of the means.

The rest position of the means will be the position it has when the means is not biased at all. This rest position preferably is a position where the means is generally flat, and wherein the dispenser is then adapted to hold the means in a bent position.

Alternatively, the rest position of the means may be bent, and the dispenser bending the means into a flat or another bent shape.

As mentioned above, preferably the dispenser is able to hold the means in a manner so that the means is curved in a direction at least substantially along a longitudinal direction thereof.

In the preferred embodiment, the dispenser preferably comprises an opening adapted to receive a finger of a user in order to introduce and/or remove the means from the slot. Preferably, this opening is elongated along at least a predominant part of the slot in order for the finger to engage the means and bring it at least a substantial part into or out of the slot in a single movement. In one embodiment, the opening is positioned at the other side (opposite to the upper side) of the means in order to prevent access to the upper side via the opening. Alternatively, the opening is positioned relative to the upper surface or predetermined part(s) thereof so that access to the units is still prevented.

In a second aspect, the invention relates to a method of operating the above dispenser, the method comprising inserting the means in the dispenser.

Then, the inserting step could comprise bending the means prior to insertion thereof. Alternatively, the inserting step could comprise bending the means during insertion thereof.

When the dispenser comprises the extending portion, the method could comprise inserting the means in the dispenser by sliding the means over and past the extending portions and into the slot.

A third aspect of the invention relates to a method of operating the above dispenser, the method comprising removing the means from the dispenser.

When the dispenser comprises the extending portion, the method could comprise bending the means even further from its rest position in order to bring it over the extending portions and sliding the means over the extending portions and out of the slot.

BRIEF DESCRIPTION OF THE DRAWINGS

In the following, preferred embodiments of the invention will be described with reference to the accompanying drawing, where.

DETAILED DESCRIPTION OF THE INVENTION

FIG. 1A-1F show the preferred embodiment of a device/dispenser 1 for holding a means B illustrated in the form of a blister card. It will become clear that any bendable means may be used in stead of the blister card.

Figure 1D:
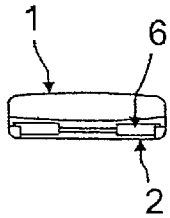
FIG. 1A-1F illustrate a first preferred embodiment of a device according to the invention, and with means for monitoring the position of a blister card.
Figure 1A:
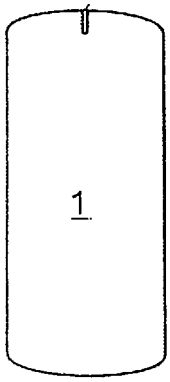
Figure 1B:
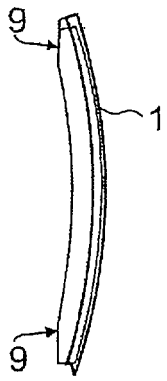
Figure 1C:
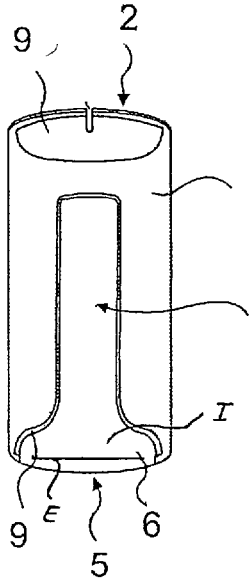
Figure 1F:
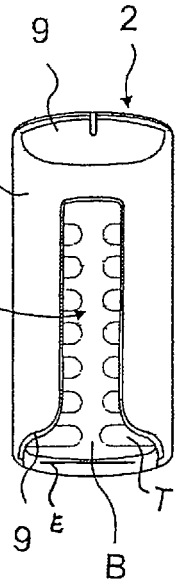
Figure 1E:
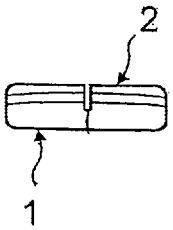

In FIG. 1F, the device is shown with a blister card B inserted into the device. The device 1 has a closed surface 2 and oppositely thereto a partly open surface 3. The partly open surface 3 has a slot or opening 4 extending partly down the surface. The slot 4 is intended for inserting a finger for sliding the blister card B into and out of the device. The one end 5 of the device has an inlet 6 for inserting the blister card into and taking the blister card B out of a slot S of the device. The other end of the device 1 has monitoring means for registering the position of the blister card B.

The monitoring means is intended for registering a first position of the blister card B within the device, said first position being a position where the blister card is fully or almost fully inserted into the device. Fully or almost fully inserted is a position where the closed surface 2 covers all of the tablets in the blister card B, so that not even one tablet can be taken from the blister card.

The monitoring means is preferably also intended for registering another position of the blister card B in relation to the device, said other position being a position where the blister card B is fully or partly pulled out of the device. Fully or partly pulled out is a position where the closed surface 2 does not cover the tablets T in the blister card B, or at least does not cover outer tablets in the blister card, so that at least one tablet can be taken.

The device is designed (See FIG. 1B) so that the closed surface 2 and the opposite surface 3 are curved. This has the advantage that when the blister card B is inserted through the inlet 6 into the device, the blister card B will be bent compared to the planar configuration of the blister card B before insertion into the device. The bending of the blister card B will lead to the blister card B being wedged in the device, thereby holding the blister card B in the device without any elements as such for holding the blister card B within the device.

Thus, when the blister card B is inserted into the device through the inlet and is pushed all the way to the first position, where the blister card B is fully inserted in the device, the blister card B cannot drop out of the device. The curvature of the closed surface and the partly open surface 3 may have any rise H of the curvature in relation to a length of the blister card B. The only demand of the rise H of the curvature is that the blister card B must be so hardly wedged as not to drop out of the device by accident, perhaps when the inlet 6 of the device is directed downwards.

The inner surface I of the dispenser further has an extending portion E toward which the blister card B is biased during insertion and removal thereof. The extending portion E is positioned further toward the opening 6 than any part of the card B so that the extending portion E does not engage the blister card B unless the blister card B moves in a direction out of the slot S.

The device is also so designed that the one end 5 and the other end 6 of the device have flattened parts 9. The flattened parts 9 enable the placement of the device at a supporting surface such as a table. The device also has a shape and a size making it possible easily to bring the device along during the day, either in a bag, even a small lady's handbag, or in a pocket of a shirt or of a pair of trousers. The size of the device is not much larger than the size of the blister card B contained in the device. Thus, the device itself will not be limiting the compliance of the user, only the "discipline" of the user will determine the compliance.

Figure 2:
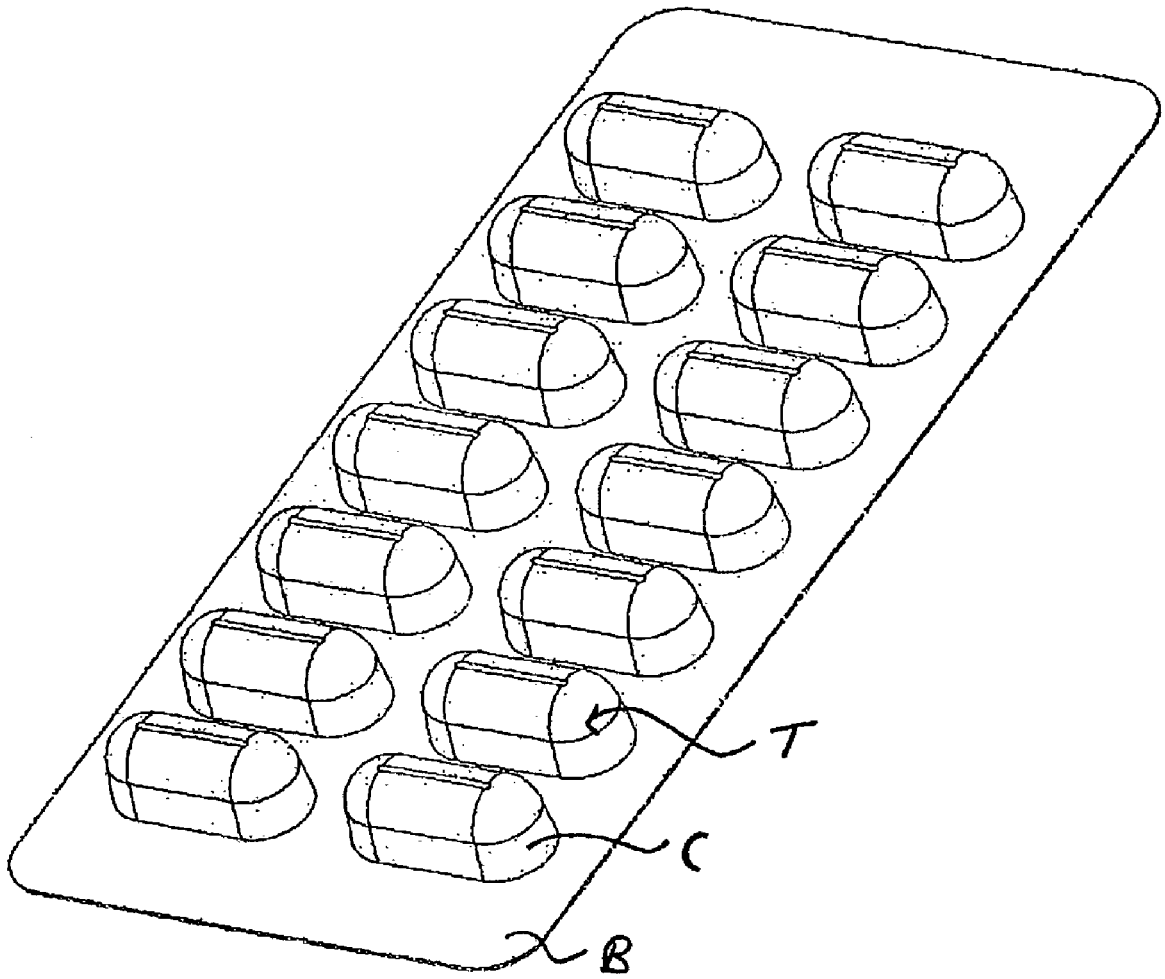
FIG. 2 illustrates a blister card.

In FIG. 2, the blister card B is illustrated with a number of compartments C each holding one or more tablets T or the like. The upper side U of the blister card being that having the foil, which is to be broken in order to gain access to the tablets T.

The invention claimed is:

1. An assembly, comprising a bendable blister card holding a plurality of units to be dispensed to a user and a dispenser holding the blister card, the blister card having an upper surface from which access may be obtained to one or more of the plurality of units, and the blister card having a rest position; and the dispenser having a rest position wherein the blister card is maintained such that the blister card is biased against side portions thereof and stored in a position different from the rest position of the blister card preventing access to the plurality of units, the dispenser having a slot able to receive the blister card therein, the side portions being positioned within the slot, and the dispenser having an opening adapted to receive a finger of a user in order to introduce and/or remove the blister card from the slot, the opening elongated along at least a predominant part of the dispenser such that the finger of the user can engage and move the blister card at least partly into or out of the slot, wherein the blister card is inserted into the dispenser, which bends in a circumferential direction.

2. The assembly according to claim 1, wherein the dispenser also being adapted to hold the blister card such that the dispenser covers at least a predetermined part of the upper surface in order to prevent access to units.

3. The assembly according to claim 1, wherein the slot is adapted to fully receive the blister card through the opening, and wherein the side portions comprise a portion extending away therefrom and into the slot, the extending portion being positioned at a position further toward the opening of the slot than a position of any part of the blister card.

4. The assembly according to claim 1, wherein the rest position of the blister card is a position where the blister card is generally flat, and wherein the dispenser is adapted to hold the blister card in a bent position.

5. The assembly according to claim 4, wherein the dispenser being able to hold the blister card in a manner such that the blister card is curved in a direction at least substantially along a longitudinal direction thereof.

6. A method of operating the assembly according to claim 1, the method comprising inserting the blister card in the dispenser.

7. The method according to claim 6, wherein the inserting step comprises bending the blister card prior to insertion thereof.

8. The method according to claim 6, wherein the inserting step comprises bending the blister card during insertion thereof.

9. A method of operating the assembly according to claim 3, the method comprising inserting the blister card in the dispenser by sliding the blister card over and past the extending portions and into the slot.

10. A method of operating the assembly according to claim 1, the method comprising removing the blister card from the dispenser.

11. A method of operating the assembly according to claim 3, the method comprising bending the blister card even further from the rest position in order to bring the blister card over the extending portions and sliding the blister card over the extending portions and out of the slot.

12. The assembly according to claim 1, wherein the dispenser is bent in the rest position.

13. The assembly according to claim 1, wherein the dispenser is permanently bent in the rest position.

14. The assembly according to claim 1, wherein the blister card is maintained in the rest position without external forces.

15. The assembly according to claim 1, wherein a width of the opening is narrower than a width of the dispenser.

* * * * *